US008858068B2

(12) United States Patent
Goeller et al.

(10) Patent No.: US 8,858,068 B2
(45) Date of Patent: Oct. 14, 2014

(54) WATCH MOVEMENT COMPRISING A FUSEE

(71) Applicant: Montres Breguet SA, L'Abbaye (CH)

(72) Inventors: Eric Goeller, Colombier (CH); Sylvain Marechal, Bois-d'Amont (CH)

(73) Assignee: Montres Breguet SA, L'Abbaye (CH)

( * ) Notice: Subject to any disclaimer, the term of this patent is extended or adjusted under 35 U.S.C. 154(b) by 0 days.

(21) Appl. No.: 14/088,564

(22) Filed: Nov. 25, 2013

(65) Prior Publication Data

US 2014/0146646 A1 May 29, 2014

(30) Foreign Application Priority Data

Nov. 27, 2012 (EP) ..... 12194477

(51) Int. Cl.
*G04B 1/10* (2006.01)
*G04B 1/16* (2006.01)

(52) U.S. Cl.
CPC ..... *G04B 1/16* (2013.01)
USPC ..... 368/140; 368/203

(58) Field of Classification Search
USPC ..... 368/139–140, 142, 144, 203
See application file for complete search history.

(56) References Cited

U.S. PATENT DOCUMENTS

| | | | | |
|---|---|---|---|---|
| 20,888 | A | 7/1858 | Muma | |
| 1,468,267 | A * | 9/1923 | Johnston et al. | 368/273 |
| 2,496,690 | A * | 2/1950 | Bennett, Jr. | 368/185 |
| 2010/0243377 | A1 * | 9/2010 | Duval | 185/37 |

FOREIGN PATENT DOCUMENTS

| | | |
|---|---|---|
| CH | 10599 A | 1/1896 |
| EP | 1 970 778 A1 | 9/2008 |

OTHER PUBLICATIONS

European Search Report from EP 12 19 4477 dated Jun. 20, 2013.

* cited by examiner

*Primary Examiner* — Sean Kayes
(74) *Attorney, Agent, or Firm* — Sughrue Mion, PLLC

(57) ABSTRACT

The watch movement comprises a motor barrel (102), a fusee (104) having a main surface that has a spiral groove (148), means (192) for winding the movement arranged to drive the fusee, a going train (200) arranged to be driven by the fusee, and a wire (106) extended between the fusee and the barrel. The watch movement additionally comprises a fixed guide (155; 255) and a winding roller (157; 257) mounted to slide on the fixed guide, wherein the winding roller is arranged to guide the wire when the fusee turns and to simultaneously assure the insertion of the wire into the groove (148) and its removal therefrom.

4 Claims, 4 Drawing Sheets

WATCH MOVEMENT COMPRISING A FUSEE

This application claims priority from European Patent Application No. 12194477.1 filed 27, Nov. 2012, the entire disclosure of which is incorporated herein by reference.

FIELD OF THE INVENTION

The present invention relates to a watch movement comprising a motor barrel, a fusee, means for winding the movement arranged to drive the fusee, a going train arranged to be driven by the fusee and a transmission chain, cord or wire extended between the fusee and the barrel and arranged to unwind from the fusee and to wind up onto the barrel so that the barrel drives the going train when the fusee rotates in a first direction, and arranged to unwind from the barrel and to wind onto the fusee so that the winding means wind the barrel when the fusee rotates in a second direction.

PRIOR ART

Clocks of relatively small dimensions actuated by a spring instead of the usual weight appeared in the fifteenth century. These first spring-driven clocks were markedly less precise than clocks driven by a weight suspended from a wire. In fact, as is well known, the force exerted by a spring is not constant but decreases as the spring slackens. The verge and foliot escapements used at that period were extremely sensitive to variations in motor torque. Therefore, the spring-driven clocks had a tendency to slow down progressively as the power reserve ran out.

Using a fusee is a very old solution for equalising the force delivered by a barrel spring to the going train. The attached FIGS. 1 and 2 show two traditional embodiments of a barrel coupled to a fusee. FIG. 1 is a schematic sectional view of the wheel train assembly of a timepiece comprising a fusee. In this figure reference 2 generally indicates the barrel, 4 indicates the fusee, 6 is the chain extended between the barrel and the fusee, 8 is the large wheel that a ratchet system (not shown) rotationally fixes to the fusee in a single direction, 10 is the axis of the fusee and finally 12 is a square formed on the axis of the fusee to allow the winding operation. With reference now to the more detailed view in FIG. 2, it can be seen that a fusee consists essentially of a conical pulley, in which the groove winds in a spiral and which is connected to the motor barrel by a chain. The chain is wound from the barrel onto the fusee so that the smallest radius receives the highest force. As the spring motor relaxes, the chain winds progressively onto the barrel pulling on the fusee with a lever arm that continuously increases in size in order to compensate for the reduction in the force of the spring.

With reference once again to FIG. 1, it can be seen that the large wheel 8 is arranged to drive the centre pinion 14 and that classically the centre wheel 16 then meshes with the third pinion 18, that the third wheel 20 meshes with the second pinion 22 and then the second wheel 24 meshes with the escapement pinion 26. It can also be seen that the axis of the centre wheel bears the cannon pinion 28 and the hour wheel 30. The cannon pinion and the hour wheel are connected to one another by the dial train 32. It can also be noted both in FIG. 1 and FIG. 2 that the illustrated barrel does not have a tooth arrangement. It will be understood that, since the barrel has no tooth arrangement, the winding operation must be conducted by means of the fusee. As a result, known fusee timepieces are usually fitted with a winding ratchet (not shown) that is integral to the axis of the fusee 4 by means of the square 12. The winding means are arranged to rotationally drive the fusee in the opposite direction to the running direction. As has already been stated, a ratchet system assures the disengagement of the large wheel 8 when the fusee rotates in the opposite direction to the running direction. Hence, the going train is not driven to run in reverse during the winding operation. On the other hand, the chain transmits the rotation of the fusee to the drum of the barrel, which results in winding up of the spring.

The use of a fusee is a very effective solution to compensate for the variation in the spring force. However, because of its conical shape the fusee has a significant space requirement in the direction of its height. It is therefore difficult to reconcile the use of a fusee with the requirements associated with the design of a flat calibre. Efforts have been made to remedy this problem by configuring fusees with smaller height and with a more compact shape. However, as in the watch of FIG. 2 in particular, the direction from which the chain winds onto the fusee must be perpendicular to the rotational axis of the fusee. In these conditions it will be understood that the slope of the cone of the fusee cannot be reduced to below a certain threshold.

BRIEF OUTLINE OF THE INVENTION

It is therefore an aim of the invention to remedy the disadvantages of the prior art that have just been described, and in particular to overcome the constraint of a minimum threshold for the slope of the cone of the fusee. The present invention achieves this aim by providing a watch movement comprising a motor barrel and a fusee in accordance with the attached claim 1.

According to the invention a winding roller is mounted to slide on a fixed guide oriented towards the axis of the fusee parallel to the main surface thereof. As a result of the presence of the winding roller, the wire changes direction to approach the fusee. Thus, instead of winding and unwinding perpendicularly to the rotational axis of the fusee, the wire winds and unwinds from the fusee perpendicularly to the orientation of the fixed guide.

According to an advantageous variant of the invention the fusee is not in the form of a cone, but that of a plate, and therefore the main surface of the fusee is flat. An advantage of this variant is to limit the height of the fusee.

According to another advantageous variant of the invention the winding roller comprises a pulley that has a groove arranged to receive the wire, while the two sides of the pulley rim are arranged to run on the base of the groove while surrounding the wire.

BRIEF DESCRIPTION OF THE FIGURES

Other features and advantages of the present invention will become clear upon reading the following description given solely by way of non-restrictive example with reference to the attached drawings.

DETAILED DESCRIPTION OF EMBODIMENTS

Figure 1:
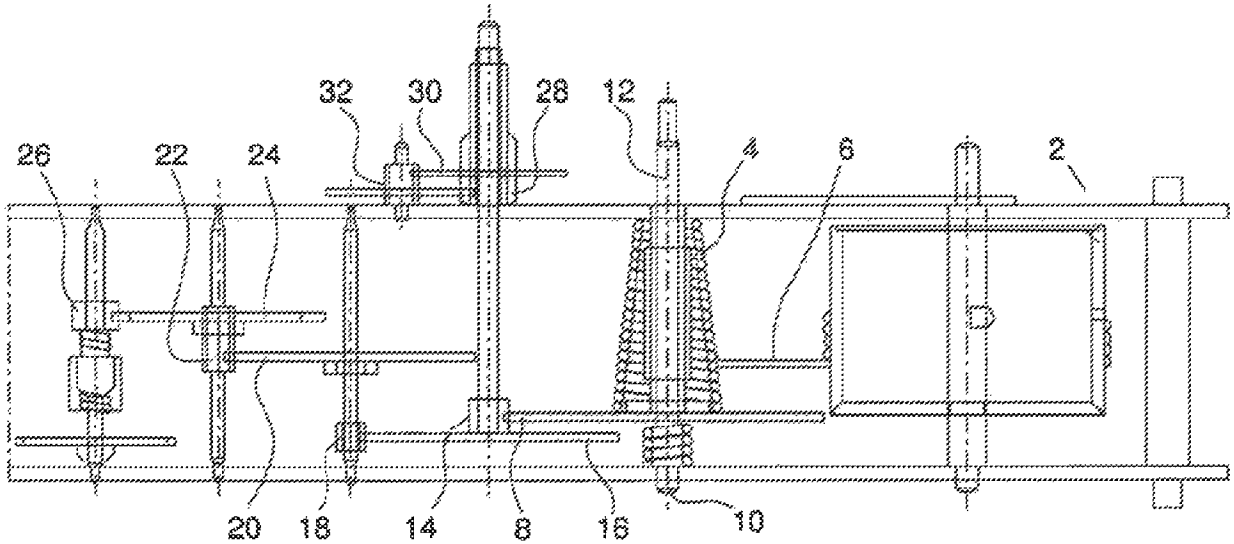
Fig. 1 (Prior art)
FIG. 1 is a schematic sectional view of the wheel train of a timepiece of the prior art comprising a fusee.
Figure 2:
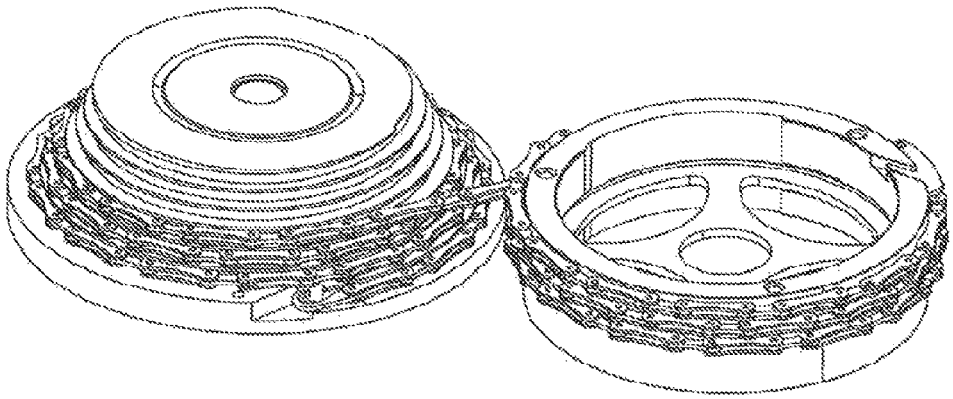
FIG. 2 is a perspective view showing the chain extended between the smooth barrel and the fusee of a timepiece of the prior art.
Figure 3:
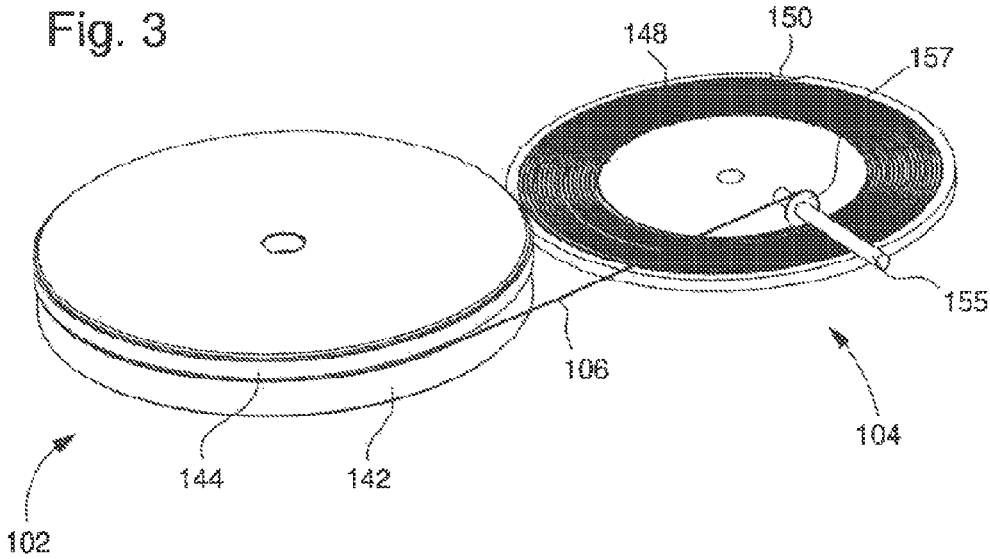
FIG. 3 is a partial perspective view showing the motor barrel and the fusee of a watch movement according to a first embodiment of the invention.
Figure 4:
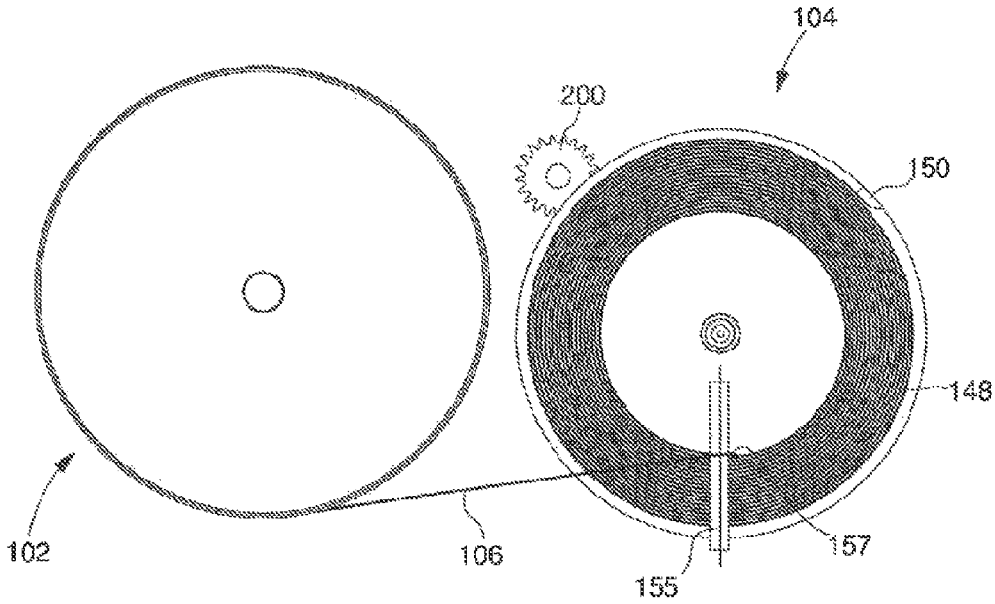
FIG. 4 is a plan view showing the motor barrel and the fusee of FIG. 3.
Figure 5:
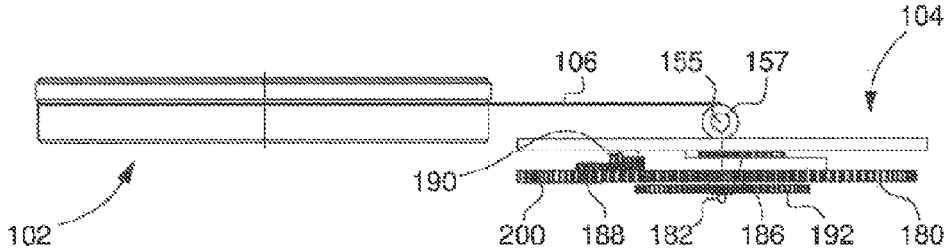
FIG. 5 is a front view of the motor barrel and the fusee of FIGS. 3 and 4.

FIGS. 3, 4 and 5 are three views: perspective, plan and side view respectively, of a first embodiment of the invention. Shown in the figures are a barrel 102, in which a barrel spring (not shown) is accommodated, and a fusee 104, which is connected to the barrel by a wire 106.

In a manner known per se, the barrel is formed from a barrel drum 142, which serves to house the spring, a barrel cover 144, which closes the box formed by the drum, and a barrel arbor (not shown), which passes through the barrel and is fixed by its ends to the bottom plate and to a bridge. The barrel arbor acts as a pivot for the barrel. The spring is held between the arbor by one of its ends and the drum by its other end. When it is wound up, the spring is wound against the circumference of the arbor. As it endeavours to resume its initial form, the spring unwinds causing the barrel to turn. The barrel 102 is kinematically connected to the rest of the movement by a wire 106. There is therefore no need for a tooth arrangement. This is referred to as a smooth barrel.

The wire 106 is extended between the barrel 102 and the fusee 104 in order to transmit a rotation movement from the barrel to the fusee and vice versa. The fusee 104 generally has the shape of a plate with a plane upper main surface, in which a spiral groove 148 concentric to the axis of the fusee is formed. On the periphery of the fusee the groove opens to a recess 150, inside which a through-hole is formed (not shown). An end of the wire 106 is inserted and fixed in the through hole. The wire is wound in the groove from the recess 150 so that the distance between the wire and the axis of the fusee 104 decreases as the end of the wire moves further away. When the spring relaxes causing the barrel 102 to turn, the wire winds around the barrel driving the fusee. As the wire is wound in a spiral on the fusee it will be understood that the barrel pulls the fusee with a lever arm that increases in size as the wire unwinds. Thus, when the force of the spring is lower, the distance separating the axis of the fusee and the application point of the force is greater. The reduction in the force of the spring can thus be compensated.

Figure 7:
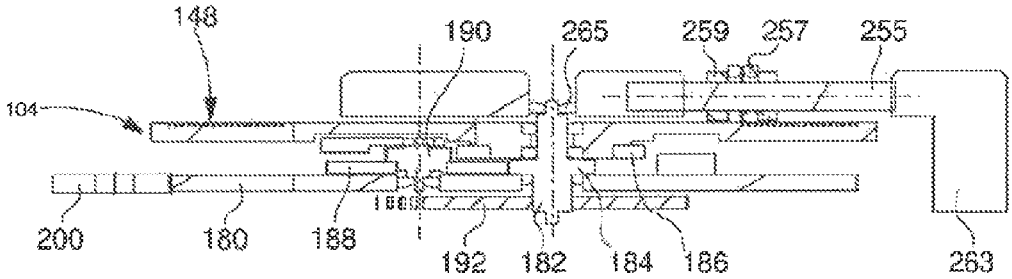
FIG. 7 is a sectional view taken along A-A of FIG. 6.

As can be seen in FIG. 5 and in more detail in the sectional view of FIG. 7, a large wheel 180, the tooth arrangement of which meshes with the centre pinion of the watch (given the reference 200), is arranged coaxially to the fusee 104. The large wheel and the fusee are mounted loosely on the two ends of the same arbor given the reference 182. It can also be seen that a planet gear is interposed between the large wheel and the fusee. The planet gear comprises a pinion 184 integral to the arbor 182, a crown gear 186, which is pressed concentrically onto the base of the fusee and a planet wheel formed from a wheel 188 and a pinion 190 pivoted in an out-of-centre position on the disc of the large wheel 180. A ratchet wheel 192 is also pressed onto the lower end of the arbor 182. In a manner known per se, a click (not shown) is also provided to prevent the ratchet from turning in a first direction of rotation.

The planet gear operates in the following manner. As it relaxes the spring slackens and causes the barrel 102 to turn. The wire 106 is progressively transferred from the fusee to the barrel driving the fusee 104 in the first direction of rotation. The jagged profile of the ratchet wheel has the effect of holding the arbor, which cannot turn with the fusee. The fusee drives the pinion 190 of the planet wheel by means of the crown 186. The wheel 188 of the planet wheel meshes with the pinion 184 integral to the arbor 182. In these conditions, when the fusee turns in the first direction, the planet wheel is driven by the crown 186. As the pinion 184 is prevented from turning by the ratchet, the planet wheel turns around the arbor 182 in the opposite direction to the fusee and entrains the large wheel 180 with it. The large wheel in turn drives the centre pinion and, by means of this, the entire going train.

The watch movement that forms the subject of the present invention usually comprises means (not shown) for winding the movement. These winding means are arranged to drive the ratchet wheel 192 in the second direction of rotation. When the ratchet wheel is actuated, it causes the pinion 184 that it is an integral part of to turn. The pinion 184 meshes with the wheel 188 of the planet wheel and drives this in the first direction of rotation. The pinion 190 of the planet wheel itself meshes with the toothed crown 186 of the fusee. It should be noted that the large wheel 180 can turn in the second direction of rotation only. In fact, in a known manner, the going train is linked to a second click mechanism (not shown), which prevents any rotation of the wheel train in the opposite direction to the running direction of the movement. In these conditions it will be understood that this locking of the large wheel 180 prevents the planet wheel from turning around the arbor 182 in the first direction of rotation. Therefore, it is the fusee that is driven in the second direction of rotation by the planet wheel via the crown 186. It will be understood that when the fusee thus turns in the second direction of rotation, the wire 106 is progressively transferred from the barrel 102 to the fusee 104 driving the barrel in the direction of rotation corresponding to the winding up of the spring.

A general feature of fusees is that the wire is wound onto a rotation surface that is not parallel to the rotational axis of the fusee. This is the reason why a spiral groove is almost always necessary to guide the wire. In the case of a flat fusee, as described in the present example, the surface onto which the wire winds is itself perpendicular to the rotational axis of the fusee. In these conditions even the presence of a groove is not sufficient to guide the wire so that it winds uniformly onto the fusee. This is the reason why, according to the invention, the watch movement comprises, in addition to the fusee, a fixed guide (given reference 155) and a winding roller (given reference 157) that is provided to guide the wire 106 and is mounted to slide on the fixed guide.

In accordance with the invention, the guide for the winding roller is oriented parallel to the main surface of the fusee and towards the axis of the fusee. In other words, in the case where the shape of the fusee is essentially that of a circular cone as in the prior art, the guide according to the invention is oriented in order to allow the winding roller to slide parallel to a generatrix of the cone. On the other hand, if the shape of the fusee 104 is essentially that of a disc, as in the illustrated example, the guide 158 is then oriented horizontally parallel to a radius of the disc. With reference more specifically to FIG. 4, it can be seen that in the illustrated embodiment the winding roller 157 is in the form of a pulley of small thickness and that the guide 155 is formed by a cylindrical arbor. The pulley is rotatably mounted on the arbor 157 and, as already stated, is also arranged to slide transversely along the arbor. The diameter of the pulley is such that its rim penetrates the spiral groove 148. When the fusee 104 turns, the pulley 157 is guided by the edges of the groove so that it travels along the groove shifting laterally along the arbor 155.

When the wire 106 winds onto the barrel 102 it winds off the fusee 104. Conversely, when the wire unwinds from the barrel it winds into the spiral groove 148. The insertion of the wire into the groove as well as its removal therefrom are assured by the pulley 157. For this purpose, the pulley has a groove around its periphery. This groove is arranged to receive and guide the wire. The peripheral part of the pulley is shaped to penetrate into the spiral groove so that when passing via the pulley, the wire is caused to pass below it so that it is sandwiched between the base of the spiral groove and the pulley groove.

As stated above, one of the aims of the present invention is to reduce the space requirement associated with a fusee. It will therefore be understood that it is advantageous to use a wire with the lowest possible thickness. In fact, if the wire is thinner, the spiral groove can also be narrower. There is currently a selection of extremely fine wires on the market. The diameter of these new generation wires lies between some tens and some hundreds of microns. Even finer wires made, for example, with nanotubes, already exist in the laboratory. In accordance with the embodiment of the invention forming the subject of the present example, the wire wound onto the barrel and the fusee can be a wire with a thickness of about 100 microns commercially available through Berkley® under the name NanoFil®. It will be understood that with such a fine wire it is possible in particular to use a very small winding roller 157. This roller can be made, for example, from sapphire in the manner of a hole jewel. In this case, the roller would be in the form of a thin disc with a groove around its periphery and a hole provided in its centre for the guide 155.

Figure 6:
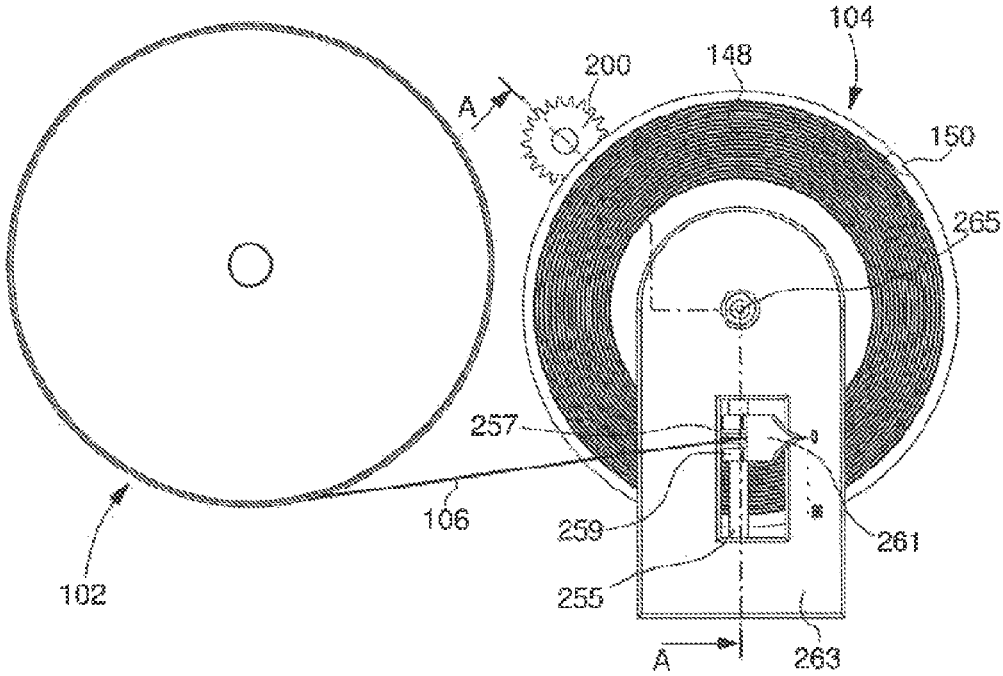
FIG. 6 is a partial plan view showing the motor barrel and the fusee of a watch movement according to a second embodiment of the invention.

FIGS. 6 and 7 show a motor barrel and a fusee used in a second embodiment of the invention. As will be seen in more detail below, in this second embodiment the winding roller also performs the function of power reserve indicator. Despite this difference, the second embodiment is very similar to the preceding one, and for this reason those elements of the figures that are identical in both embodiments have been given with the same reference numbers in the figures.

With reference more specifically to FIG. 6, it can be seen that the axis 102 of the fusee is pivoted in a bearing block 265 supported by a bridge 263. This bridge also bears the guide for the winding roller. This guide is formed by an arbor 255 suspended on the bridge 263 by its two ends. The bridge 263 also has a rectangular opening, through which it is possible to see the guide 255 and the winding roller 257. In the illustrated example, the winding roller is linked to a slide 259 fitted with an index 261. The slide 259, which is fixed against translation movement to the winding roller, is visible through the rectangular opening arranged in the bridge. The index 261 always indicates the position of the roller and the bridge 263 also bears a graduated scale arranged to face the rectangular opening. The end of the index is arranged to cooperate with the graduated scale to indicate the power reserve.

In addition, it will be understood that various modifications and/or improvements evident to the skilled person can be made to the embodiments forming the subject of the present description without departing from the framework of the present invention defined by the attached claims. In particular, the winding roller is not necessarily formed by a pulley rotatably mounted on an axis. In fact, the wire could equally be arranged to slide into the groove of the roller without this being turned onto itself.

What is claimed is:

1. A watch movement comprising a barrel having a barrel drum, a barrel arbor and a spring accommodated in the barrel drum, said spring being held between said arbor and said drum, wherein the movement additionally comprises a fusee arranged to rotate in a first direction and in a second direction and having a main surface, which has a spiral groove concentric to the axis of the fusee, a winding mechanism arranged to rotate the fusee in the second direction, a going train arranged to be driven by the fusee and a transmission wire extended between the fusee and the barrel, one of the ends of the wire being wound into the spiral groove, and the wire being arranged to unwind from the spiral groove of the fusee and to wind up onto the barrel so that the barrel drives the going train when the fusee rotates in the first direction and being arranged to unwind from the barrel and to wind onto the fusee guided by the spiral groove so that the winding mechanism winds the spring when the fusee rotates in the second direction, wherein the watch movement comprises a fixed guide and a winding roller mounted to slide on the fixed guide and arranged to guide the wire between the barrel and the fusee, wherein the fixed guide is oriented in the direction of the axis of the fusee parallel to the main surface of the fusee, and the winding roller is arranged to slide on the guide transversely to the wire while being engaged in the spiral groove in order to pass through the groove, extracting the wire therefrom when the fusee rotates in the first direction and inserting the wire therein when the fusee rotates in the second direction.

2. The watch movement according to claim 1, wherein the winding roller comprises a pulley having an edge arranged to penetrate into the spiral groove and having a peripheral groove arranged to guide the wire.

3. The watch movement according to claim 1, wherein the main surface of the fusee is plane.

4. The watch movement according to claim 1, wherein the winding roller is fixed against translation movement to an index arranged to cooperate with a fixed scale oriented parallel to the fixed guide in order to indicate the power reserve.

* * * * *